United States Patent [19]

Bixby

[11] Patent Number: 4,989,577

[45] Date of Patent: Feb. 5, 1991

[54] POWER UNIT BOW

[76] Inventor: Ray Bixby, Box 11, Lillian, Tex. 76061

[21] Appl. No.: 253,602

[22] Filed: Oct. 5, 1988

[51] Int. Cl.[5] ..... F41B 5/10

[52] U.S. Cl. ..... 124/25.6; 124/24.1; 124/900

[58] Field of Search ..... 124/23 R, 24 R, 25, 124/DIG. 1, 16, 23.1, 24.1, 25.6, 900; 403/146, 145, 229

[56] References Cited

U.S. PATENT DOCUMENTS

| | | | |
|---|---|---|---|
| 42,317 | 4/1864 | Stevens | 124/24 R |
| 126,734 | 5/1872 | Morton | 124/23 R |
| 428,912 | 5/1890 | Holmes . | |
| 1,029,716 | 6/1912 | Roe | 124/24 R |
| 1,161,642 | 11/1915 | Enos, Jr. . | |
| 1,231,770 | 7/1917 | Martineau | 124/24 R |
| 2,116,650 | 5/1938 | Zima . | |
| 2,714,377 | 8/1955 | Mulkey | 124/24 R |
| 3,518,980 | 7/1970 | Hamm . | |
| 3,744,473 | 7/1973 | Nishioka | 124/DIG. 1 X |
| 3,812,835 | 5/1974 | Smith | 124/25.6 |
| 3,981,290 | 9/1976 | Islas | 124/25.6 |
| 3,989,026 | 11/1976 | Nishioka | 124/DIG. 1 X |
| 4,078,537 | 3/1978 | Carella | 124/24 R |
| 4,338,900 | 7/1982 | Plummer . | |
| 4,512,326 | 4/1985 | Jarrett | 124/DIG. 1 X |
| 4,688,539 | 8/1987 | Lawrence | 124/DIG. 1 X |
| 4,756,295 | 7/1988 | Guzzetta | 124/DIG. 1 X |
| 4,803,970 | 2/1989 | Mattheck et al. | 124/23 R |
| 4,903,677 | 2/1990 | Colley et al. | 124/DIG. 1 X |

*Primary Examiner*—Peter M. Cuomo

*Attorney, Agent, or Firm*—Hoffman, Wasson & Gitler

[57] ABSTRACT

A power unit archery bow wherein a frame member is secured with respect to a first end of at least one limb member by a spring-actuated power unit. A bow string secured to a second distal end of the limb member is adapted to engage an arrow and to be drawn rearwardly by a user. Retraction of the bow string causes the limb member to rotate rearwardly, whereby the entire length of the limb member is utilized to load the spring member of the power unit. Upon release of the bow string, the energy stored by the power unit spring is instantaneously released, being transmitted to the limb member to rotate the limb member to its original position so as to straighten the bow string and propel the arrow forwardly. Because the entire length of the limb member provides leverage to the power unit, the requisite pull force for the bow is greatly reduced.

5 Claims, 7 Drawing Sheets

POWER UNIT BOW

BACKGROUND OF THE INVENTION

1. Field of the Invention

The invention pertains generally to archery bows. More particularly, the invention relates to an archery bow which utilizes the full length of the limbs to activate a power unit that transfers energy to an arrow upon release of the bow string.

Traditionally, archery bows are formed as a unitary structure having limbs which possess a resistance to bending when a bow string extending between the limbs is pulled back in a direction away from the bow. When the bow string is drawn back, the limbs are deformed, behaving essentially as springs whereby energy is created and stored in the deformed limbs. When the bow string is released, the limbs are restored to their original unflexed position, and the stored energy of the limbs is released, thereby causing straightening of the bow string and propulsion of an arrow which is mounted on the string.

Bows of the foregoing type are generally characterized by the limb members being utilized to deform another portion of the limb members upon retraction of the bow spring, and thus require a high pull force on the bow string in order to achieve high speed and long range for the arrow. Additionally, bows of the latter type must possess a uniform spring rate in order to obtain consistent accuracy and a uniform propelling force upon the arrow.

Archery bows wherein a significant portion of the limbs is deflected in order to transmit a greater reaction propelling force to the string and, hence, the arrow, are costly and difficult to fabricate. The need to establish a uniform spring rate in the limbs further increases the costs of construction for such archery bows.

Prior art efforts to enhance the restoring force which the limbs exert on the bow string have generally involved the addition of extraneous elements at the string end of the limbs. These elements, such as pulleys, camming devices and the like, add to the complexity and manufacturing costs for the bow.

Thus, the need exists for an archery bow which effectively reduces the pull force required for the bow, while substantially increasing the restoring force transferred to the arrow upon release of the bow string in a consistently accurate manner. Additionally, the need exists for a bow having the latter attributes, and which is simple, economical, and conducive to manufacture.

The subject invention realizes the foregoing objects and benefits by providing an archery bow wherein the entire length of the bow's limbs is utilized as a lever to activate a power unit associated with the limbs opposite the string ends of the limbs. The pull force imposed on the bow string by a user is directed to rotate the limbs solely to activate the power unit, rather than to bend the limbs themselves in order to create a reaction force as with conventional archery bows.

The power unit of the present invention comprises a pair of spring members, one for each limb, which are energized by the mechanical lever-action of the limbs when the bow string is drawn. Upon release of the bow string, the restoring force which the power unit spring exerts on the limbs causes the limbs to restore the bow string to a taut position and project an associated arrow. The length of the limbs and the strength of the springs may be varied to obtain diverse power and pull characteristics. Because the entire length of the limbs is utilized as a lever to load the power unit, the archery bow of the subject invention is capable of achieving high power and speed outputs with relatively low pulling force requirements. Moreover, each limb of the archery bow of the invention activates its respective spring separately, thereby insuring uniform propelling forces on the arrow and consistent accuracy.

2. Description of the Prior Art

It is known in the prior art to provide spring members on archery bows to increase the restoring force imposed upon the bow string. U.S. Pat. No. 4,338,909, issued on July 13, 1982 to Plummer, teaches an archery bow wherein arms which are pivotally secured to the main beam member uncoil a respective spring upon drawing back of the bow string. Release of the bow string results in recoiling of the springs and simultaneous movement of the arms and, thus the bow string, to their original position. The springs, however, are secured to the string ends of their respective arms, and the arms thus do not contribute leverage action to the springs to reduce the required pull force, but serve merely to stretch the springs.

U.S. Pat. No. 3,518,980, which issued to Hamm on July 7, 1970, discloses a bow including a center section, the ends of which are adjustably secured within tubular outer sections. Each outer section has a spring disposed therein, with one end of the spring secured to its respective outer section and the other end of the spring secured to the bow string. The springs are placed in tension when the bow string is retracted, and cause straightening of the string when the string is released.

The prior art also discloses the concept of providing a spring member in the center portion of the bow. For example, U.S. Pat. No. 428,912, to Holmes, which issued on May 27, 1890, shows an archery bow having a coil spring pivotably secured to the ends of the center body of the bow. The ends of the spring are coiled to form an arm, to which the bow string is attached. The fact that the arms are formed of spring steel limits the bow to toleration of only the slightest of pulls.

Similarly, U.S. Pat. No. 1,161,642, which issued to Enos, Jr. on Nov. 23, 1915, discloses a bow fabricated entirely of spring steel and being defined by a central coil spring and a pair of spring arms. The spring arms of Enos, Jr., being made of spring steel, would suffer the same limitations as the bow of Holmes.

Finally, the bow disclosed by Zima, U.S. Pat. No. 2,116,650 dated May 10, 1938, is characterized by a centrally located spring which serves to increase, rather than decrease, the pull force required for the bow.

None of the foregoing prior art references provide or suggest the teachings for an archery bow specifically characterized by a spring-loaded power unit mounted between the riser of the bow and each of the ends of the bow limbs opposite the string in a structural arrangement which utilizes the full length of the limbs as leverage to load the power unit.

SUMMARY OF THE INVENTION

The invention pertains to an archery bow which is particularly adapted to reduce the pull force required for the bow by utilizing the entire length of each limb member to activate a power unit secured to and mounted between the riser member and the respective limb members. The invention departs from conventional teachings in that the limb members are not deformed upon retraction of the bow string, but rather, are rotated around a pivot point associated with the respective power unit for purposes of energizing the power unit.

The preferred embodiment for the archery bow of the invention includes a riser member having upper and lower ends associated with a power unit. Each power unit comprises a spring member, the first end of which is secured to each of the upper and lower ends of the riser. The second end of each spring member is secured to the end of a limb member. The opposite free ends of the limb members are joined by a bow string, which is placed under light tension by the spring members. Each spring member is associated with pivot means which establishes a pivot point around which the respective limb member is rotated when the bow string is drawn rearwardly by a manual pull force applied thereto.

Rotation of the limb members upon drawing back of the bow string results in the full length of each limb member being utilized as a lever to deform the spring member is such a manner as to create stored energy in the spring member. When the bow string is released, the spring member abruptly resumes its undeformed position such that the energy stored in the spring member is transferred instantaneously to the limb members to straighten the bow string and to propel an arrow forward.

Because the full length of the limb members contribute to the leverage force, and because the pull force on the bow string is not required to directly bend the limb members themselves, or to deform the spring member unassisted, the archery bow of the instant invention is able to achieve high power and speed outputs with reduced pull force requirements.

Although the preferred embodiment for the invention employs a double torsion spring member for the power unit, alternative embodiments for the invention contemplate utilizing a variety of diverse spring members, such as flat spring members, compression spring members and extension spring members. Additionally the invention presents several alternative embodiments directed to unique orientations for the limb members, a single limb archery bow and a crossbow.

DETAILED DESCRIPTION OF THE PREFERRED EMBODIMENT

Figure 1:
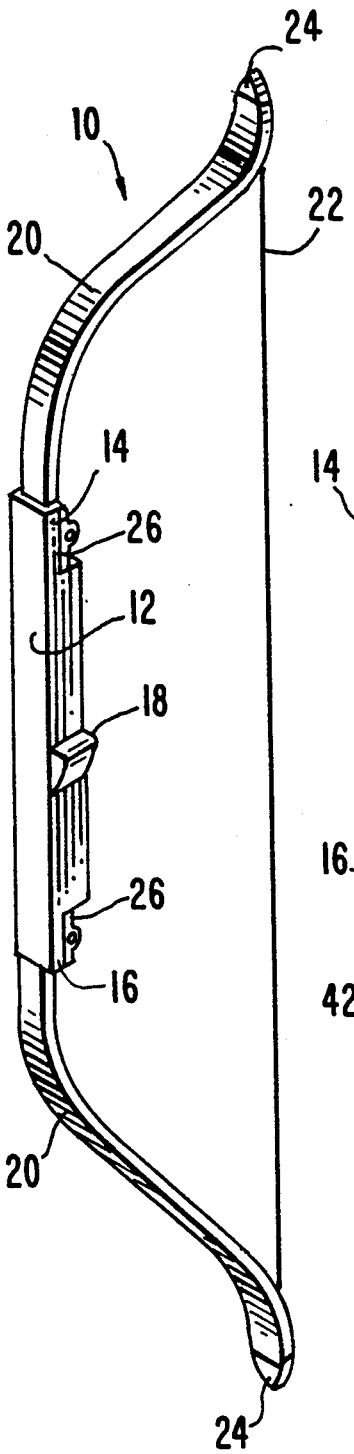
FIG. 1 is a perspective view of a preferred embodiment for the archery bow of the present invention.
Figure 2:
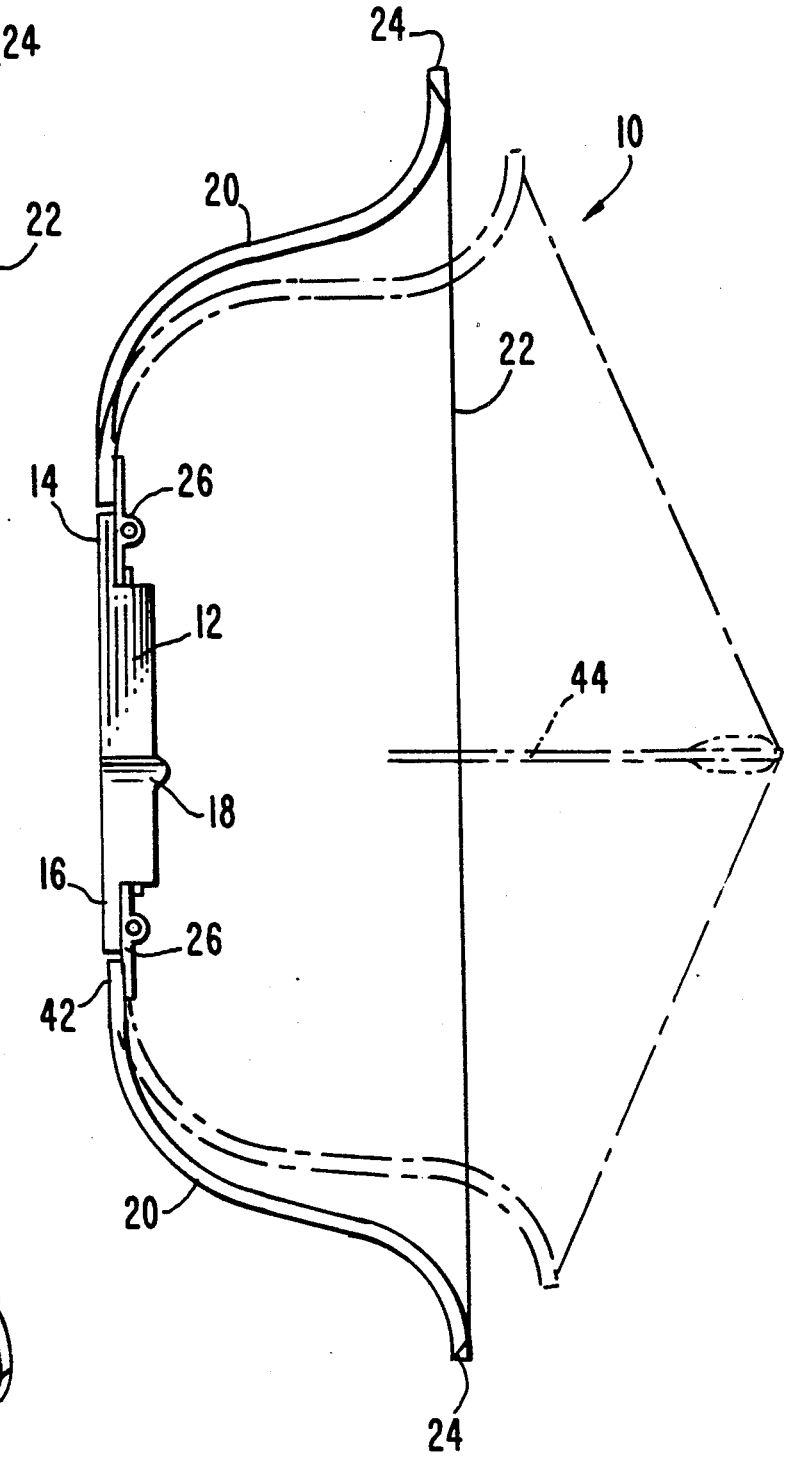
FIG. 2 is a side plan view of the archery bow of FIG. 1, with the operative position for the bow being shown in phantom.
Figure 3:
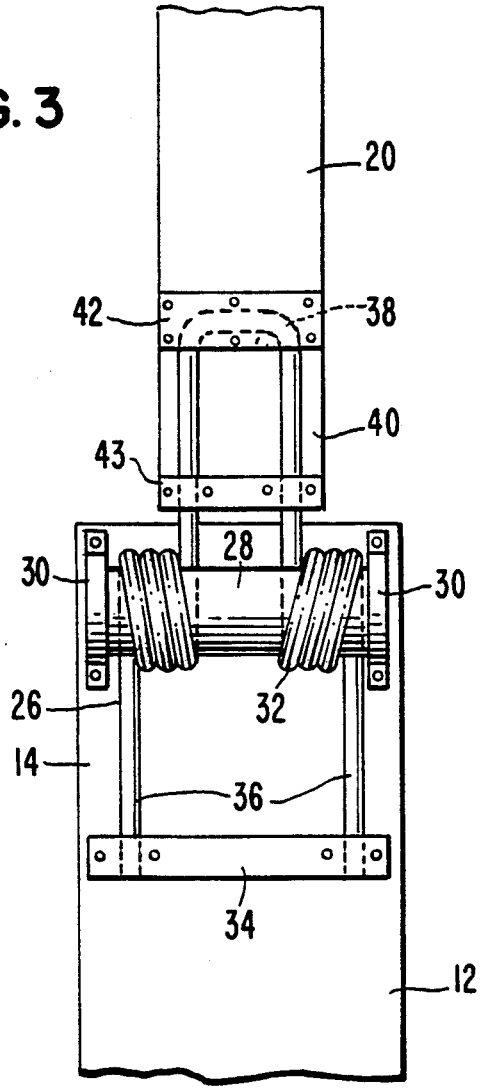
FIG. 3 is a fragmentary front plan view of the archery bow of FIG. 1.

A preferred embodiment for the archery bow for the present invention is particularly illustrated in FIGS. 1–3, wherein it can be seen that the archery bow, indicated generally at 10, comprises a central riser member 12 having upper and lower ends 14, 16, respectively, and a hand grip 18. A limb member 20 is associated with each of the upper and lower ends of the riser member. A bow string 22 is secured in tension between and to the distal free ends 24 of the limb members.

A power unit 26 is disposed between each of the upper and lower ends of the riser member and its respective limb member. Each of the power units is identical and, thus, will be discussed in detail only in terms of the power unit located at the upper end of the riser member This power unit, as best depicted in FIG. 3, includes a pivot shaft 28 provided with brackets 30 at each of its ends for securing the shaft to the upper end 14 of the riser member 12 by means of bolts, screws or like securing means. A double torsion helical spring 32 is mounted on the pivot shaft 28, with the coils of the spring 32 being fitted loosely around the shaft. A bracket 34 extends between the first and second ends 36 located on the riser end of the spring for purposes of securing the ends 36, and hence the spring, with respect to the upper end of the riser member. As with brackets 30, the bracket 34 is intended to be similarly secured to the upper end of the riser by means of bolts, screws or other appropriate securing means.

The integral end 38 located on the limb end of the spring 32 is secured to the straight end 40 of the limb member 20 by means of brackets 42, 43 which are secured to the end of the limb member in the manner previously discussed in connection with brackets 30 and 34. As can be seen in FIG. 2, a power unit as thus described is secured to and between the lower end 16 of the riser member and the end 42 of the lower limb member. The springs 32 of each power unit are intended to be slightly loaded.

With further reference to FIG. 2, it can be seen that the bow string 22 has each of its free ends secured to a distal unsecured end 24 of the limb members. The bow string is intended to be secured to the ends 24 of the limb members such that the string is subjected to a light tension pull from the slightly loaded spring members 32.

The operative position for the archery bow 10 is illustrated in FIG. 2. As shown therein, the bow string, with an arrow 44 nocked thereon, is adapted to be manually drawn back by the user to the required position, as dictated by the length of the arrow. The limb members 20 of the bow are pulled by the string to rotate inwardly toward each other, as shown in phantom in FIG. 2. The full length of each limb member is thus utilized as a lever to coil the spring member 32 of its respective power unit as the limb member rotates in response to pull on the bow string. When the bow string is released, the energized torsion spring members instantly uncoil, so as to release their stored energy and straighten the bow string. The arrow is thereby propelled forward with greater force and speed.

It is apparent from the foregoing discussion that the archery bow of the present invention does not rely upon deformation or deflection of the limb members to impart a reaction force to the bow string for propulsion of the arrow. Instead, the present archery bow utilizes the full length of the limbs, which are secured at their straight ends to a power unit and at their opposite ends to the bow string, as levers to activate the power units. Consequently, the rotational movement of the limbs under influence of the pull force applied to the bow string is directed to the power units for the purpose of creating stored energy in the spring members. Because the limb members are not utilized themselves as springs, and because they are not required to be deformed, the archery bow results in a significant reduction in pull force necessary to obtain high power and speed outputs.

Naturally, the length of the limb members and the strength of the spring members may be varied in order to achieve diverse pull force and output power parameters. The archery bow is thus adaptable to numerous practical applications, such as target, hunting, play or military uses.

Figure 5:
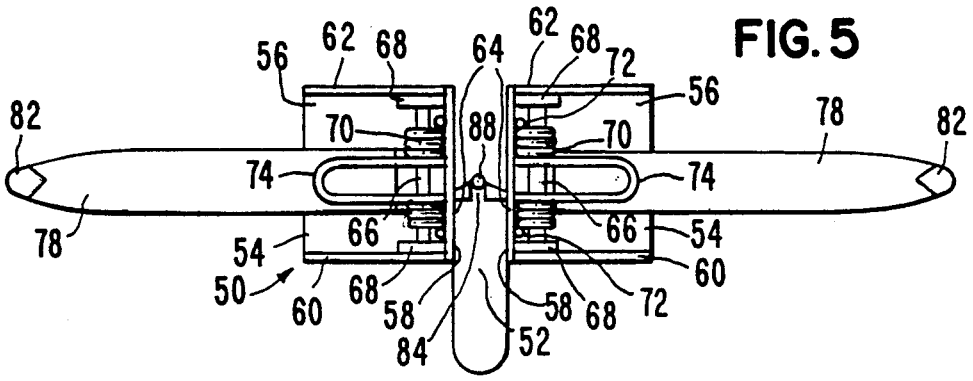
FIG. 5 is a front plan view of the first alternative embodiment of FIG. 4.
Figure 4:
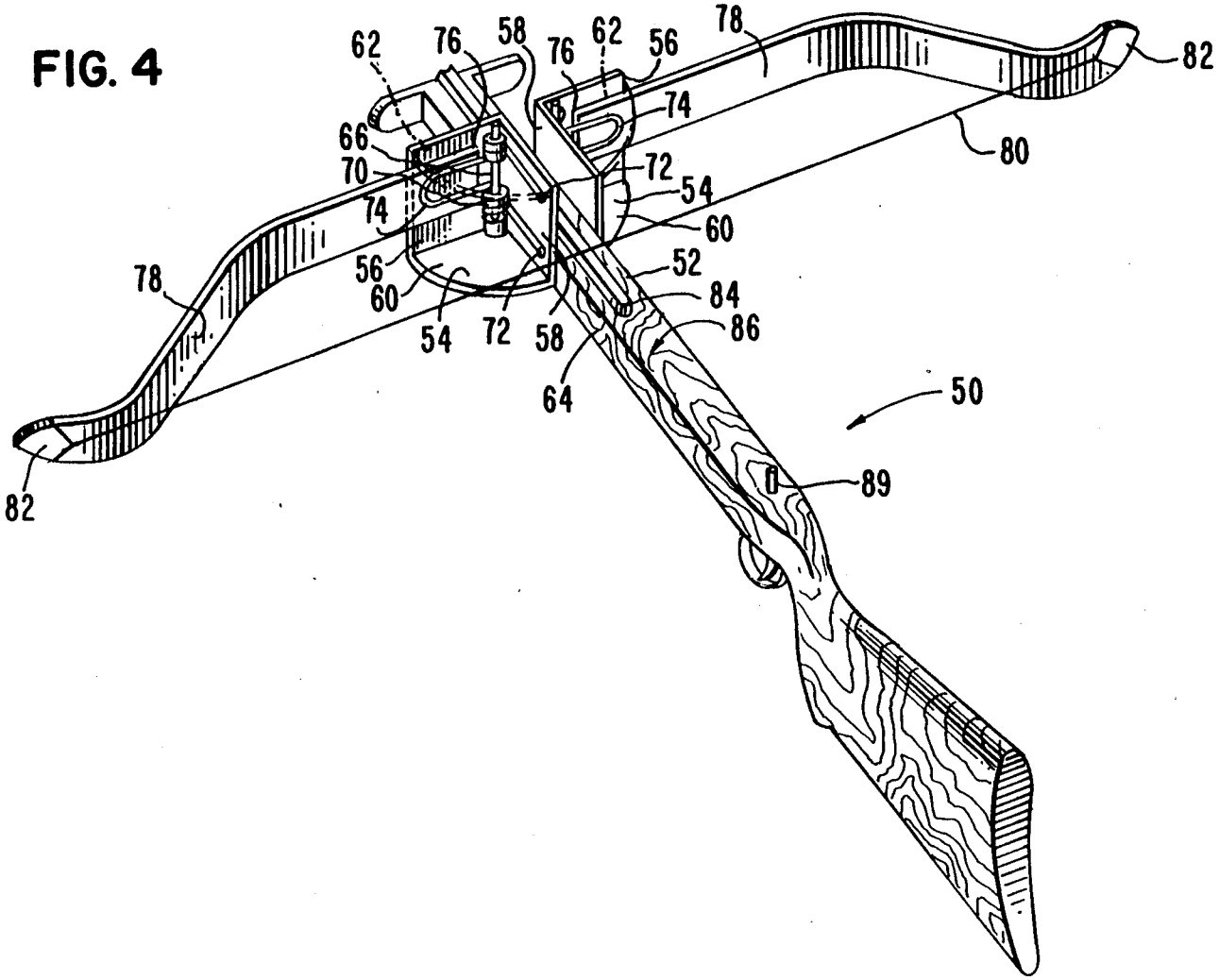
FIG. 4 is a perspective view of a first alternative embodiment for the archery bow of the present invention.

FIGS. 4 and 5 illustrate a first alternative embodiment for the present invention in the form of a crossbow. The crossbow 50 comprises a stock 52, to which is secured by suitable securing means a pair of angular bracket members 54. Each bracket member is defined by intersecting perpendicular vertical side walls 56, 58 and bottom and top walls 60, 62 extending between the vertical walls. The top walls 62 of the bracket members are shown in phantom in FIG. 4. The bracket members are mounted on opposite sides of the stock 52, with the walls 58 of the bracket members abutting respective planar sides 64 of the stock. The walls 58 of the bracket members are intended to be secured to the sides 64 of the stock by bolts, screws or any suitable alternative securing means.

A pivot shaft 66 is mounted vertically within each of the bracket members parallel to the side walls 56, 58 of the bracket member and generally closely situated to the corner formed by the intersecting walls 56, 58. The pivot shaft is fixedly mounted in the latter location by means of pivot shaft retainers 68. The retainers 68 fixedly receive the opposite ends of the pivot shaft and are, in turn, secured to the adjacent bottom and top walls 60, 62 of the bracket members.

A double torsion spring member 70 is disposed on each of the pivot shafts, being retained thereon by the retainers 68. The first and second ends 72 of the spring members are secured to the walls 58 of the bracket members. The ends 72 may be secured to the walls 58 by means of bracket members, as was discussed in connection with the preferred embodiment, or by any other appropriate securing means.

The integral end 74 of each spring member is secured to the straight end 76 of a limb member 78. This securement may likewise be accomplished by means of brackets, as was discussed in connection with the preferred embodiment. When thus secured to the spring end, each of the limb members lies parallel to and in abutting relationship to the side walls 56 of the bracket member such that the exterior rear surface of each limb member continuously abuts its respective side wall 58.

A bow string 80 has each of its free ends secured to a distal end 82 of the limb members so as to place the limbs under light tension in the manner discussed in relation to the preferred embodiment.

An arrow guide rail 84 is mounted on the top surface 86 of the stock for receiving the arrow 88 shown in FIG. 5. Additionally, a firing mechanism 89 is similarly secured to the top surface of the stock.

The crossbow is adapted to be operated by the user placing an arrow in the arrow guide rail, with the fletched end of the arrow in engagement with the bow string, and by manually pulling back the bow string to engage the firing mechanism. As the bow string is pulled back, the limbs are pulled inwardly toward the string, causing the spring members 70 to coil as was previously discussed in connection with the preferred embodiment. When the bow string is released, the energy created due to coiling of the spring members is released and transferred to the limb members and to the bow string, thus propelling the arrow forward.

Figure 6:
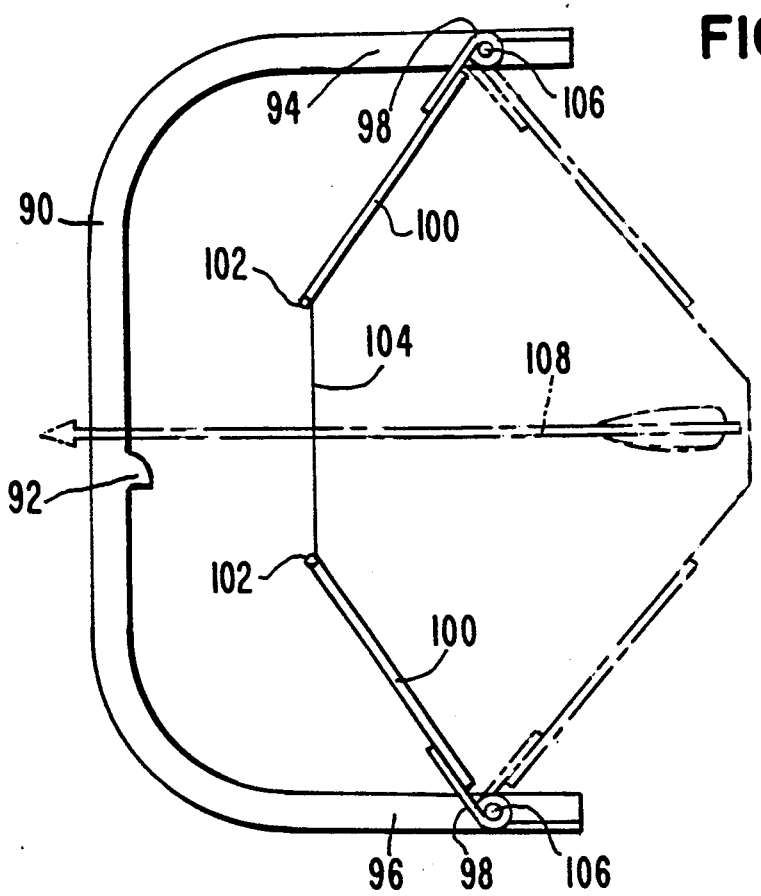
FIG. 6 is a side plan view of a second alternative embodiment for the archery bow of the present invention, with the operative position for the bow being shown in phantom.

A third alternative embodiment for the invention is shown in FIG. 6. The archery bow illustrated in FIG. 6 comprises a frame member 90 of generally C-shaped configuration and having a generally central hand grip 92 and upper and lower ends 94 and 96. A power unit including a double torsion helical spring member 98 secures each of the ends 94, 96 to a limb member 100 such that the distal ends 102 of the limb members point downwardly and inwardly toward the center of the hand grip side of the frame member. A bow string 104 is secured to and between the distal ends 102 of the limb members under slight tension from the power unit spring members.

The spring members 98 are each mounted on a pivot shaft 106 fixedly attached to the ends 94, 96 of the frame member. The pivot shaft serves as the pivot point for the spring member and for the respective limb member. As has been discussed in connection with the preferred embodiment, one end of each spring member is secured to its respective end of the frame member, and the other end of the spring member is secured to the end of its respective limb member.

The operative position for the archery bow, shown in phantom in FIG. 6, is obtained by the user manually pulling the arrow 108 and the bow string 104 rearwardly with respect to the frame member. Consequently, the limb members 100 are rotated rearwardly and the spring members are rotated around the pivot shafts to coil the spring members to store energy therein. Upon release of the bow string, the energy stored in the spring members is abruptly released and transferred to the limb members, the bow string and the arrow. As with each of the previously discussed embodiments, the full length of the limb members is utilized as a lever to activate the power unit.

Figure 7:
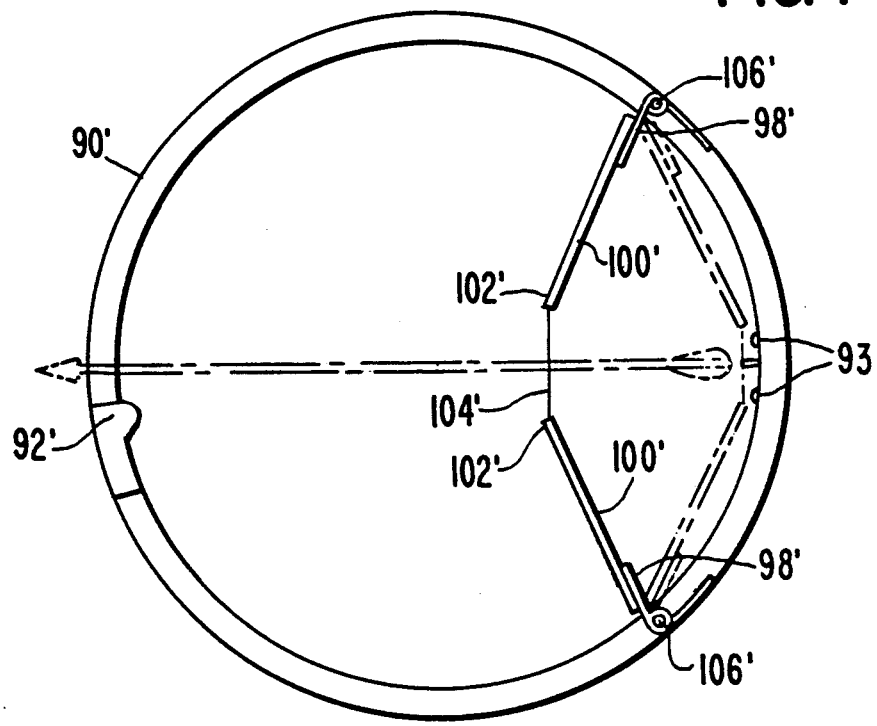
FIG. 7 is a side plan view of a third alternative embodiment for the archery bow of the present invention, with the operative position for the bow being shown in phantom.

A fourth alternative embodiment for a power unit archery bow is depicted in FIG. 7. The embodiment illustrated in FIG. 7 is generally identical in principle to the embodiment of FIG. 6, except that the frame member 90' forms a complete circle. The frame member has a generally central hand grip 92' provided on a first side of the frame, the top of which is located approximately one inch below an imaginary horizontal line passing through the center of the sides of the circle formed by the frame. A pair of finger locator guides 93 are provided on the second side of the frame member opposite the hand grip, one finger locator disposed on each side of the aforementioned horizontal line.

A pair of pivot shafts 106' are located on the frame opposite the hand grip, with a pivot shaft being located above and below the imaginery horizontal line. Each pivot shaft is located with respect to the horizontal line a distance generally equal to one-eighth the circumference of the frame member. A double torsion spring member 98' is mounted on each pivot shaft with one end of the spring member secured to the frame and the other end of the spring member secured to the end of a respective limb member 100', as was discussed in relation to the embodiment of FIG. 6.

As was also discussed in connection with the preceding embodiment, the distal ends 102' of the limb members 100' point downwardly and inwardly toward the hand grip side of the frame member, with bow string 104' joining the distal ends.

The power unit bow of FIG. 7 is adapted to be operated by a user pulling the bow string, with an arrow nocked thereon, rearwardly toward the finger locators until the bow string and arrow are positioned against the guide locators. Upon retraction of the bow string, the limb members are simultaneously drawn rearward, resulting in coiling of the spring members and storage of energy therein. Upon release of the bow string, the stored energy of the spring members is instantaneously transmitted to the limb members, to the bow string and to the arrow to propel the arrow forward.

Figure 8:
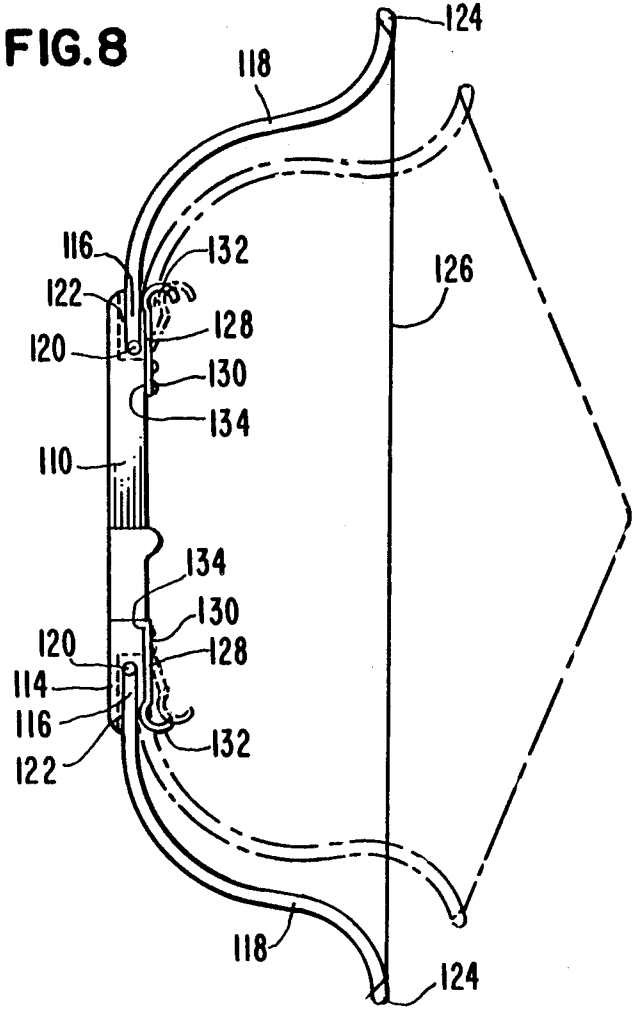
FIG. 8 is a side plan view of a fourth alternative embodiment for the archery bow of the present invention, with the operative position for the bow being shown in phantom.

FIG. 8 depicts a fifth alternative embodiment for the archery bow of the present invention. The archery bow shown in FIG. 8 includes a riser member 110 having upper and lower ends 112, 114. The upper and lower ends of the riser are each associated with the ends 116 of limb members 118. The ends 116 of each limb member is provided with a pivot pin or shaft 120 which is pivotably secured in a recessed portion 122 formed in the ends 112, 114 of the riser. The opposite distal ends 124 of the limb members secure the tensioned bow string 126.

A spring member 128 having a flat end 130 and a curved end 132 has its flat end fixedly secured to the inner side 134 of the riser at the ends 112, 114. The flat ends of the spring members are secured to their respective ends of the riser just slightly inward of the pivot shaft, with the curved end of the spring extending outwardly toward the ends 116 of the limb members. Each spring member is disposed with respect to the riser such that the curved portion of the spring member presses against the end 116 of its respective limb member, creating a force biasing the ends of the limb member toward the riser.

When the bow string is manually pulled rearward by a user, the entire length of each limb exerts full leverage on the spring member, deflecting the curved end of the spring member inwardly as shown in phantom in FIG. 8. Bending of the spring members creates stored energy in the spring, the biasing force of the springs being directed against the limb members to restore them to their original position when the bow string is released.

Figure 9:
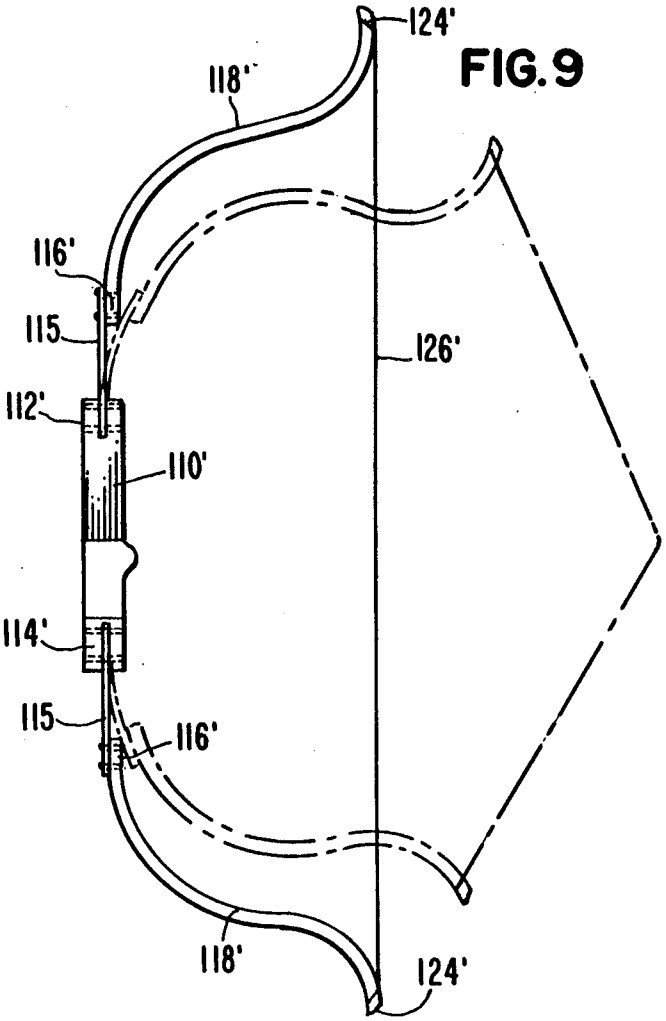
FIG. 9 is a side plan view of a fifth alternative embodiment for the archery bow of the present invention, with the operative position for the bow being shown in phantom.

A sixth alternative embodiment for the invention, similar to the embodiment of FIG. 8, is illustrated in FIG. 9. The riser member 110' of FIG. 9 has upper and lower ends 112', 114', each of which is secured to a first end of a flat spring member 115. The second end of each spring member is secured to an end 116' of a limb member 118'. The outer ends 124' of the limb members are joined by the bow string 126'. The length of bow string required is that length which imposes a light load on the spring members.

A manual pull on the bow string draws the limb members rearwardly and inwardly so that the full length of the limbs is exerted to cause the spring members to flex inwardly, as shown in phantom in FIG. 9. The energy stored in the spring members as a result of this deformation is directed against the limb members, the bow string and the arrow when the bow string is released.

The length of the riser member 110' is preferably held to a minimum in order for the limb members to be as long as possible for the particular bow, thereby providing for greater leverage and lower required pull force.

Figure 10:
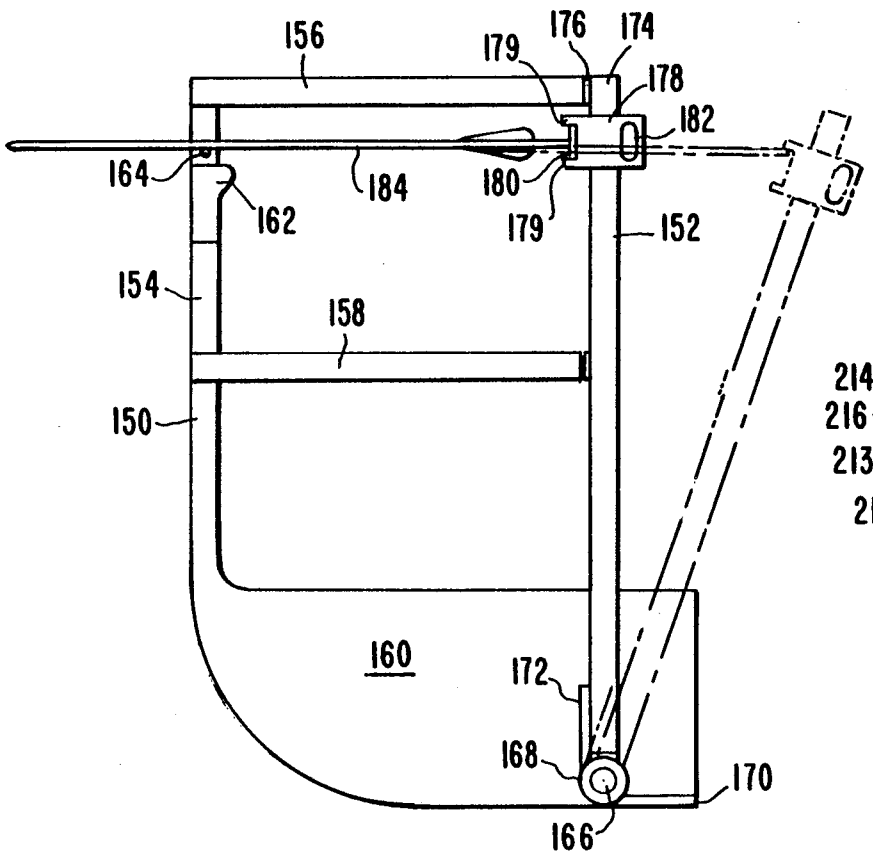
FIG. 10 is a side plan view of a sixth alternative embodiment for the archery bow of the present invention, with the operative position for the bow being shown in phantom.

FIG. 10 illustrates a seventh alternative embodiment for a power unit archery bow characterized by a riser or frame member 150 and a single limb member 152. The riser member is of generally E-shaped configuration, being defined by a generally vertical section 154, a top horizontal section 156, an intermediate horizontal section 158, and a bottom horizontal section 160. The top and bottom horizontal sections are oriented perpendicular to the vertical section. A hand grip 162 is provided proximate the top of the vertical section 154. An arrow rest 164 is provided on the vertical section slightly above the hand grip. The top, bottom and intermediate sections may be fabricated from separate components which are suitably connected together to form the E-shaped frame, or may be formed as a unitary member.

A pivot shaft 166 is rigidly secured to the bottom frame section opposite the vertical section. A double torsion spring member 168 is fitted loosely around the shaft. The first end 170 of the spring is fastened to the bottom frame section, while the second end 172 of the spring is fastened to an end of the limb member 152. The limb member 152 is disposed generally perpendicular to the bottom section, extending vertically such that the top of the opposite free end 174 of the limb member rests against a limb stop 176 provided on the end of the top section 156 under light pressure supplied by the spring member.

A bracket 178 is mounted on the free end 174 of the limb member slightly above the location of the hand grip on the vertical section. A first side of the bracket is formed with upper and lower extensions 179 facing the vertical section 154, between which extends a bow string 180. The opposite side of the bracket member is formed with a finger loop 182.

The bow string is adapted to have an arrow 184 knocked thereon whereby, when the limb member is manually pulled rearwardly by means of the finger loop, the limb rotates rearwardly and coils the spring member. The spring member becomes loaded as a result of the coiling of the spring and, upon release of the limb, its energy is released to return the limb to its rest position, thereby projecting the arrow.

Figure 11:
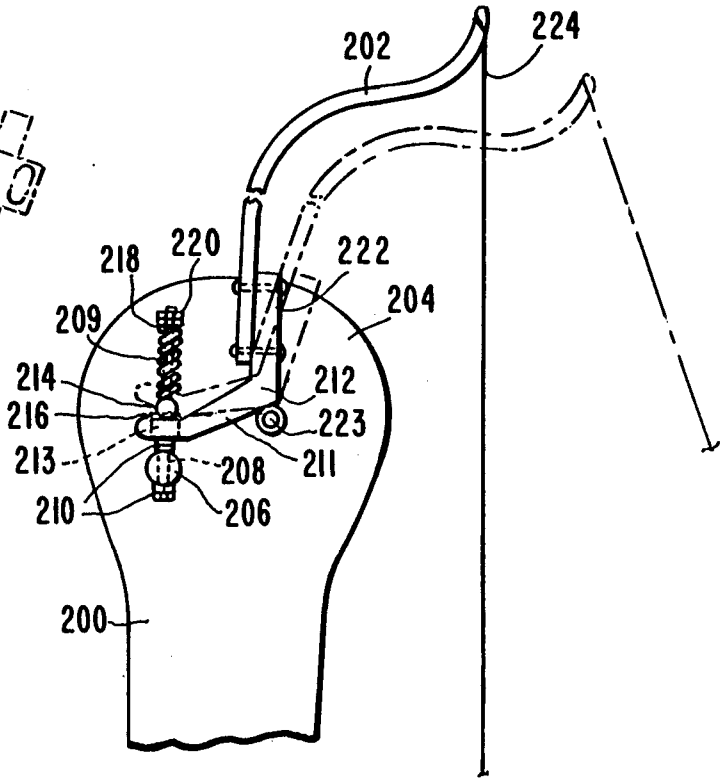
FIG. 11 is a fragmentary side plan view of a seventh alternative embodiment for the archery bow of the present invention, with the operative position for the bow being shown in phantom.

An eighth alternative embodiment for the invention, as shown in FIG. 11, comprises a riser member 200 and a pair of limb members 202, only the upper one of which is depicted in FIG. 11. The riser has upper and lower ends, only the upper end 204 being shown in the drawing as the lower end and related structural assembly is identical to that of the upper end.

An anchor pin 206 is firmly fastened to the upper and lower ends of the riser member, while being free to rotate about its longitudinal central axis. A hole is drilled through the anchor pin generally perpendicular to its longitudinal axis for receiving a spring shaft 208 upon which is disposed a compression spring 209. A nut 210 is provided on the shaft both above and below the anchor pin.

The spring shaft passes through an aperture 213 formed in the lower diagonal end 211 of a diagonal foot member 212, through a sliding friction ball 214, through first thrust washer 216, through compression spring 209, through second thrust washer 218 and thence through nut 220.

The upper vertical end 222 of the foot member 212 is secured to the end of the limb member. The foot member, at the point of intersection for the diagonal and vertical ends, is mounted on the pivot shaft 223 secured to the riser. The opposite unsecured end of the limb member secures the bow string 224 in slight tension.

When the bow string is drawn back, the limb members rotate downwardly and inwardly under influence of the pull force applied by a user to the bow string. As shown in phantom in FIG. 11, rotation of the limb members results in rotation of the diagonal foot member around the pivot shaft 223. As the foot member rotates, its lower diagonal end 211 pivots upwardly against the compression spring 209 so as to compress the spring. When the pull force on the bow string is terminated, the restoring force of the spring causes the lower diagonal end of the foot member to be abruptly directed downwardly to rotate the foot member, whereupon the vertical end of the foot members and, hence, the limb members instantaneously return to their original position so as to straighten the bow string and propel the arrow.

Figure 12:
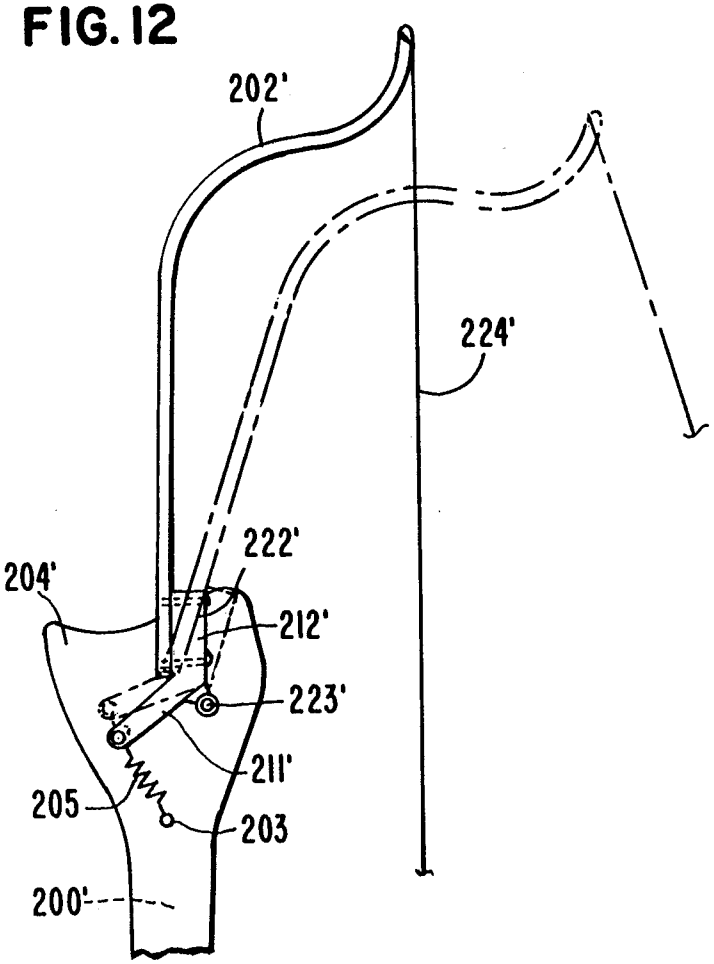
FIG. 12 is a fragmentary side plan view of an eighth alternative embodiment for the archery bow of the present invention, with the operative position for the bow being shown in phantom.

FIG. 12 illustrates a ninth alternative embodiment for an archery bow according to the principles of the present invention. The ninth alternative embodiment depicted in FIG. 12 is essentially similar to the embodiment of FIG. 11, except that it utilizes an extension spring member rather than a compression spring member. In particular, the archery bow of FIG. 12, only the upper half of which is shown, comprises a riser member 200' and a limb member 202'. A spring anchor pin 203 is provided on the upper end 204' of the riser. A first end of extension spring member 205 is secured to the anchor pin at approximately a 45 degree angle with respect to the longitudinal center line of the riser member.

A diagonal foot member 212' having a vertical end 222' and a diagonal end 211' is secured to the end 204' of the riser member by means of a pivot shaft 223', the foot member 212' being rotatable therearound. The second end of the extension spring member 205 is attached to the lower end 211' of the foot member at approximately a 90 degree angle with respect to the diagonal end of the foot member. The vertical end 222' of the foot member 212' is secured to the end of the limb member 202'.

When the lightly tensioned bow string 224' is drawn back, as shown in phantom in FIG. 12, the limbs are rotated, whereby the lower end of the foot member is rotated upwardly to extend the spring member. When the bow string is released, the restoring force of the spring is directed to the limb members, to the bow string and to the arrow in the manner discussed in connection with the preceding embodiment.

Figure 13:
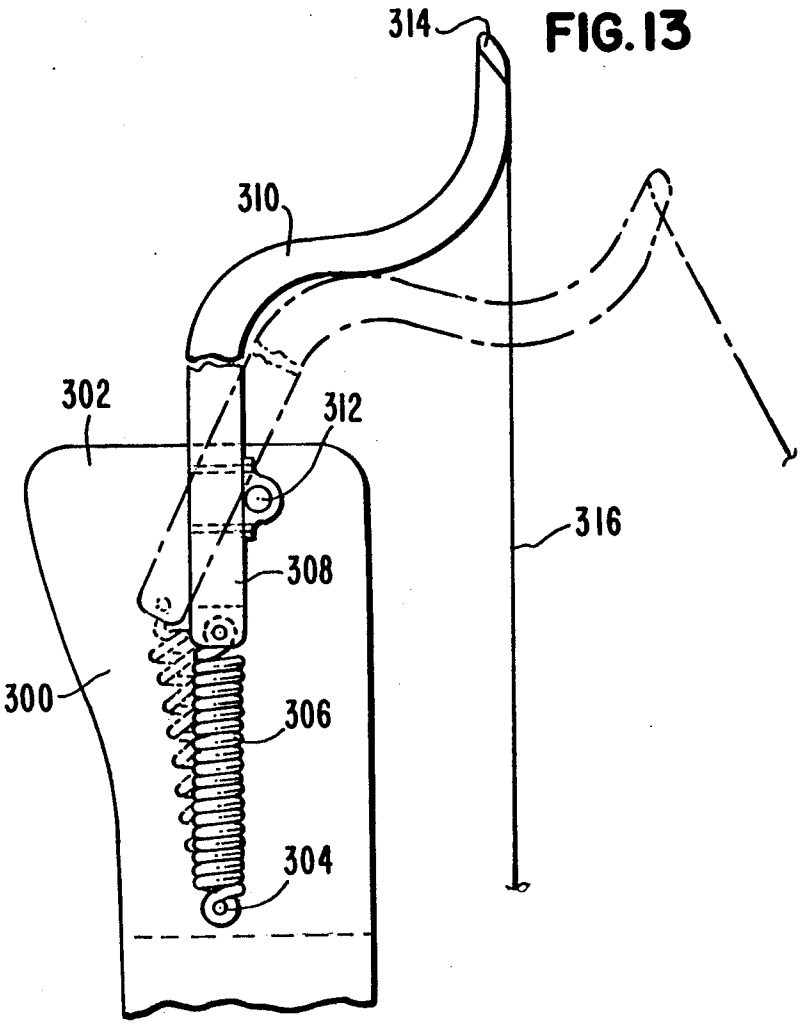
FIG. 13 is a fragmentary side plan view of a ninth alternative embodiment for the archery bow of the present invention, with the operative position for the bow being shown in phantom.

A tenth and final alternative embodiment for the present invention is depicted in FIG. 13, the upper portion of the power unit bow being shown therein, the lower portion of the archery bow being essentially identical to the upper portion. The archery bow of FIG. 13 includes a riser member 300 having an upper end 302 to which is attached a spring anchor pin 304. A first end of a vertical extension spring 306 is secured to the anchor pin. The second end of spring 306 is hingedly attached to the end 308 of limb member 310.

Limb member 310, at a location slightly above the hinged attachment of spring 306 is pivotably secured with respect to the riser member by means of pivot shaft 312. The unsecured distal end 314 of the limb member secures the bow string 316.

When the bow string is drawn rearwardly, it pulls the limb member rearwardly and downwardly, causing rotation of the limb member around the pivot shaft and extension of the spring member as shown in phantom in FIG. 13. Upon release of the bow string, the energy stored in the spring member is released to the limb and the bow string, thus propelling the arrow forward.

While the present invention has been described in detail in conjunction with a preferred embodiment, and several alternative embodiments, it should be noted that many modifications to the invention described herein may be apparent to one skilled in the art without departing from the spirit and scope of the appended claims.

What is claimed is:

1. An archery bow comprising a rigid frame member, said frame member having at least one end fixedly secured to a first end of a deformable spring member, the second opposite end of said spring member being directly and fixedly secured to a first end of a rigid limb member, said spring member having a plurality of coils disposed around a shaft fixedly secured to said at least one end of said frame member said limb member being adapted for rotation around said spring member, a bow string secured to the opposite unsecured second end of said limb member, said bow string being adapted to receive the end of an arrow and to be manually pulled rearward in a direction away from said frame member, whereby said limb member is rotated so as to deform said spring member to create stored energy in said spring member, said spring member being adapted to suddenly restore its undeformed position upon release of said bow string to rotate said limb member to the original position for said limb member, whereby said limb member restores said bow string to the original position for said bow string so as to project said arrow forward.

2. An archery bow comprising a rigid frame member, said frame member having at least one end fixedly secured to a first end of a deformable spring member, the second opposite end of said spring member being fixedly secured to a first end of a rigid limb member, said limb member being adapted for rotation around said spring member, wherein said frame member has an upper end and a lower end, said spring member is a double torsion spring, said first end of said spring member is fixedly secured to said upper end of said frame member, said second end of said spring member is fixedly secured to said first end of said limb member, said spring member having a plurality of coils disposed around a shaft fixedly secured to said upper end of said frame member, a second like double torsion spring member having first and second ends mounted on a second like shaft secured to said lower end of said frame member, said first end of said second spring member fixedly secured to said lower end of said frame member, said second end of said second spring member fixedly secured to a first end of a second rigid limb member, said limb members having distal unsecured second ends, a bow string secured in tension between said second ends of said limb members, said bow string being adapted to receive the end of an arrow and to be manually pulled rearward in a direction away from said frame member, said limb members being adapted to rotate rearwardly upon said pulling rearward of said bow string so as to coil said spring members, whereby said limb member is rotated so as to deform said spring member to create stored energy in said spring member, said spring member being adapted to suddenly restore its undeformed position upon release of said bow string to rotate said limb member to the original position for said limb member, whereby said limb member restores said bow string to the original position for said bow string so as to project said arrow forward.

3. The archery bow recited in claim 1 wherein said frame member comprises first and second angular bracket members mounted on opposite sides of a stock member, each of said bracket members being defined by first and second intersecting perpendicular vertical walls and top and bottom walls, said first end of said spring member is fixedly secured to said second wall of said first bracket member, said second end of said spring member is fixedly secured to said first end of said limb member, said first end of said limb member continuously abuts said first wall of said first bracket member when secured to said spring member, said pivot means is a pivot shaft upon which said spring member is mounted, said pivot shaft is secured to and between said top and bottom walls of said first bracket member parallel to said vertical walls and between said first and second ends of said spring member, a second like double torsion spring member having first and second ends is mounted on a second like pivot shaft, said first end of said second spring member is fixedly secured to said second wall of said second bracket member, said second end of said second spring member is fixedly secured to a first end of a second limb member, said first end of said second limb member continuously abuts said first wall of said second bracket member when secured to said second spring member, said second pivot shaft is secured to and between said top and bottom walls of said second bracket member parallel to said vertical walls of said second bracket member and between said first and second ends of said second spring member, said limb members having distal unsecured second ends, said bow string is secured in tension between said second ends of said limb members, said limb members being adapted to rotate rearwardly upon said pulling rearward of said bow string so as to coil said spring members.

4. The archery bow recited in claim 1 wherein said frame member is of generally C-shaped configuration, said frame member is defined by a vertical section and upper and lower horizontal sections, said limb members extending inwardly from said upper and lower ends of said frame member toward said vertical section of said frame.

5. The archery bow recited in claim 1 wherein said frame member is of circular configuration, said frame member has a first side and a second side, an imaginery longitudinal line passes through said frame member at the mid-point of and perpendicular to said first and second sides, said first pivot shaft is secured to said upper end of said frame at a distance above said imaginery line passing through said second side equal to approximately one-eighth the circumference of said frame, said second pivot shaft is secured to said lower end of said frame at a distance below said imaginery line passing through said second side equal to approximately one-eighth the circumference of said frame, said limb members extend inwardly from said upper and lower ends of said frame member toward said first side of same frame member.

* * * * *